US005971849A

United States Patent [19]

Falciglia

[11] Patent Number: 5,971,849

[45] Date of Patent: Oct. 26, 1999

[54] COMPUTER-BASED SYSTEM AND METHOD FOR PLAYING A POKER-LIKE GAME

[76] Inventor: Sal Falciglia, 386 Highview Terrace, Ridgewood, N.J. 07450

[21] Appl. No.: 08/848,134

[22] Filed: Apr. 28, 1997

[51] Int. Cl.[6] ..... A63F 1/100; A63F 9/22

[52] U.S. Cl. ..... 463/16; 463/13; 463/19; 463/42; 273/292

[58] Field of Search ..... 463/13, 16, 19, 463/20, 21, 11, 42; 273/292, 269

[56] References Cited

U.S. PATENT DOCUMENTS

| | | |
|---|---|---|
| 4,743,024 | 5/1988 | Helm et al. . |
| 4,953,869 | 9/1990 | Muhammad . |
| 5,393,057 | 2/1995 | Marnell, II . |
| 5,882,260 | 3/1999 | Marks et al. ..... 463/13 |

FOREIGN PATENT DOCUMENTS

| | | |
|---|---|---|
| 0 464 935 | of 1992 | European Pat. Off. . |
| 2 137 392 | of 1984 | United Kingdom . |

*Primary Examiner*—Jessica J. Harrison
*Assistant Examiner*—John M. Hotaling, II
*Attorney, Agent, or Firm*—Dilworth & Barrese

[57] ABSTRACT

A computer-based system and method allow at least one player to play a poker-like game using a computer. A processor processes inputs through a graphic user interface (GUI). A display displays the GUI, including: a five column by five row display matrix, in which each column and row combination includes a matrix display region defining a block of the display matrix; five selectable display regions, each selectable display region corresponding to each column of the display matrix; and a plurality of user-actuatable icons, including an actuation icon. A selectable symbol generator responds to the user inputs by randomly generating selectable symbols corresponding to poker playing cards for display. The processor causes a selected symbol to be displayed in a selected matrix display region of the display matrix, and determines whether the display matrix displays a combination of symbols corresponding to a poker hand condition. The processor generates a score for each user. The poker-playing device may be adapted for playing a poker-style game among a plurality of users, with respective scores determined and displayed, and for providing a chat room feature for interactive text transactions between players before, during, and after play.

11 Claims, 11 Drawing Sheets

COMPUTER-BASED SYSTEM AND METHOD FOR PLAYING A POKER-LIKE GAME

BACKGROUND OF THE INVENTION

1. Field of the Invention

This disclosure relates to computer-based games, and particularly to a computer-based system and method for playing a poker-like game.

2. Description of the Related Art

The game of poker has for many years been a popular game to play for recreation and for gambling. The popularity of poker as a gambling game has grown to the point in which, in recent years, gambling casinos have set up poker-based slot machine devices as an added attraction for their players. Examples of poker-based slot machine devices are described in U.S. Pat. No. 5,100,137 to Fulton and U.S. Pat. No. 5,393,057 to Marnell, II.

However, attempts to implement the game of poker in a slot machine have been limited in abilities, for example, in being limited to single-individual play, and in typically determining success from purely random card generation without user input and strategic determinations of the processing of cards, as in regular hand-held poker. Accordingly, such slot machine versions of poker have been both limited and less enjoyable to play.

Some versions of poker implemented as video games allow for user interaction to select and discard cards, but such video games have heretofore also generally been limited to single user play, and so are not adaptable to on-line and/or remote play between a plurality of users.

SUMMARY

It is recognized that poker may be implemented in a more enjoyable manner to provide both multi-user play and to allow users to have greater selection and strategic interaction with the game as well as to compete with other players.

A device is disclosed for playing a poker-style game, which includes an input device, a display, and a processor. The input device receives user inputs, and the processor processes such inputs through a graphic user interface (GUI). The display displays the GUI, including: a five column by five row display matrix, in which each column and row combination includes a matrix display region defining a block of the display matrix; five selection display regions, each selection display region corresponding to each column of the display matrix; and a plurality of user-actuatable icons, including an actuation icon.

The processor responds to the user inputs for executing an application program to cause the display of the GUI. The processor includes a selectable symbol generator, selection means, and determining means. The selectable symbol generator responds to the user inputs corresponding to actuation of an actuation icon in the GUI by the user by randomly generating a set of selectable symbols corresponding to poker playing cards for display by the selection display regions. The selection means causes a selected symbol displayed by the selectable symbol generator in at least one of the selection display regions to be displayed in a selected matrix display region of the display matrix. The determining means determines whether the display matrix displays a combination of symbols corresponding to a poker hand condition, and then generates a poker hand indication signal for indicating the poker hand condition. The processor may then generate a score for each user based on the poker hand condition.

The poker-playing device may be adapted for playing a poker-style game among a plurality of users, with respective scores determined and displayed, and for providing a chat room feature for interactive text transactions between players before, during, and after play.

BRIEF DESCRIPTION OF THE DRAWINGS

The features of the disclosed computer-based system and method will become more readily apparent and may be better understood by referring to the following detailed description of an illustrative embodiment of the present invention, taken in conjunction with the accompanying drawings, where.

DESCRIPTION OF THE PREFERRED EMBODIMENTS

Figure 1:
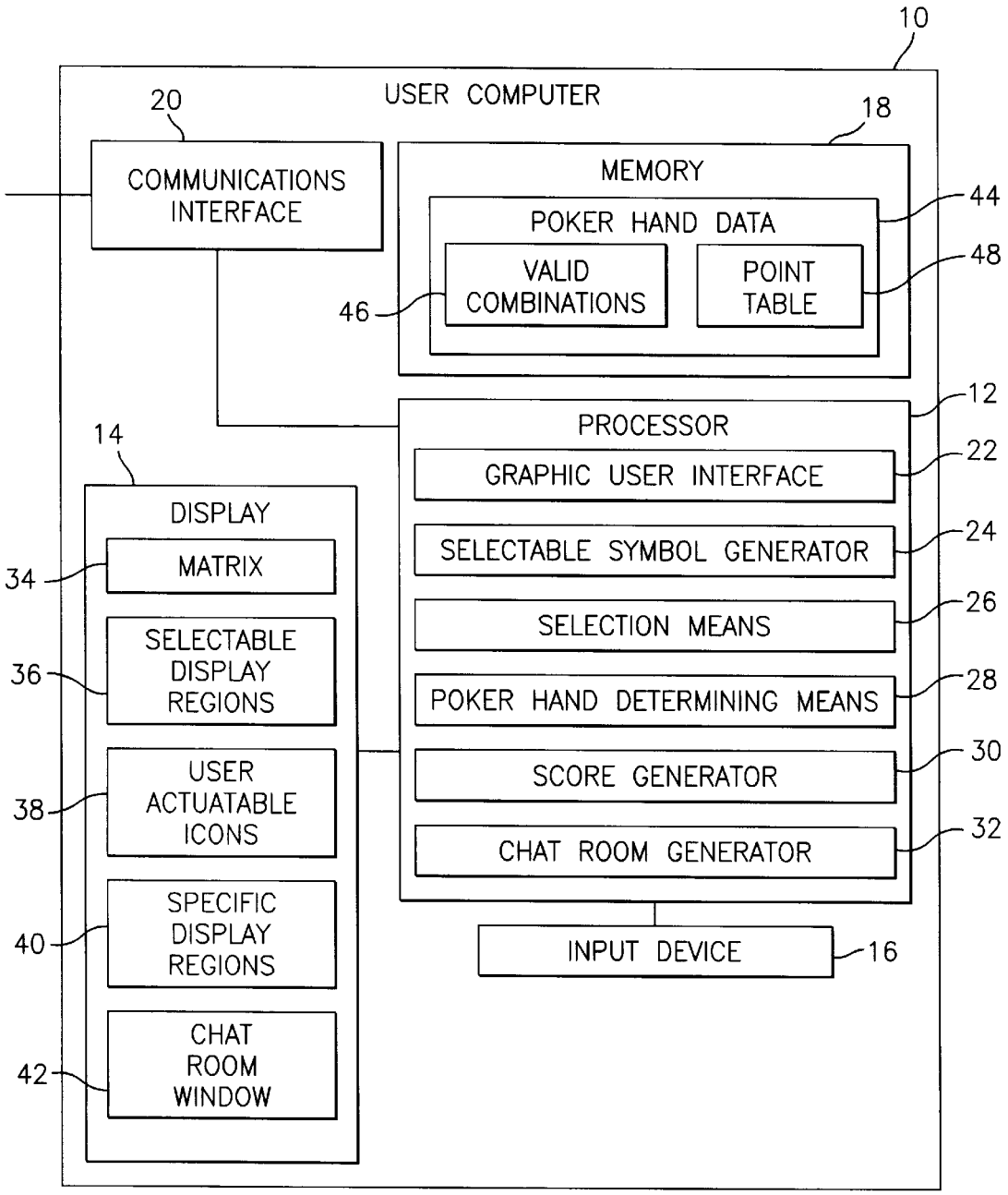
FIG. 1 is a schematic of the disclosed computer-based stand-alone device for playing a poker-like game.

Referring now in specific detail to the drawings, with like reference numerals identifying similar or identical elements, as shown in FIG. 1, the present disclosure describes a stand-alone computer-based device 10 for playing a poker-like game using graphically displayed symbols. The term "symbol" is herein defined as a graphical representation of poker playing cards, as well as special graphical symbols or pictures representing a joker, a gold coin, a devil, or text such as FREE SPIN. Preferably, the symbols include indicia corresponding to four sets of poker playing cards, with each set having numbers ranging from 2 to 10 and having letters "J", "Q", "K", and "A" standing for "Jack", "Queen", "King", and "Ace", respectively. As with a deck of poker playing cards, each of the four sets correspond to a suit having the symbols ♥, ♦, ♣, ♠, for "Hearts", "Diamonds", "Clubs", and "Spades", respectively. For example, a symbol represented by the indicia "5 ♥" corresponds to a five of hearts.

One skilled in the art would understand that such symbols may include text such a "Five Hearts" or "Five of Hearts". Alternatively, the symbols may be include icons and/or pictures, including bit-maps or GIF images as graphic representations of the standard playing cards, such as a pictorial representation of the king of hearts with a picture of a king with associated heart images.

In a preferred embodiment, the device 10 includes a processor 12, a display 14, an input device 16, and a memory 18. The device 10 may be a personal computer with the processor 12 being a microprocessor as a CPU. In a preferred embodiment, the device 10 may be a personal computer using an 80386 class microprocessor available from "INTEL" and operating, for example, at 50 MHz clock speeds. The display 14 may be a VGA monitor providing a 640×480 pixel image with 235 color resolution, and the input device 16 includes a keyboard and/or a mouse. The memory 18 may include 1 MB of RAM and a 5 MB hard drive. Optionally, a speaker as well as a sound card may also be included for generating sound effects such as background music and/or predetermined sounds in response to specific events occurring during play of the poker-like game.

For network and multi-player operation, the device 10 may include a communications interface 20 to adapt the device 10 from a stand-alone device for playing the poker-like game to a terminal for such multi-player operations to play the poker-like game in conjunction with other players, which is described in greater detail below.

The processor 12 operates an application program, stored in the memory 18 and generated from source code written, for example, in C++. In use, the processor 12 executes the application program to generate a graphic user interface (GUI) 22, for example, using "WINDOWS" 3.1, "WINDOWS 95", or "WINDOWS NT", available from MICROSOFT.

The processor 12 includes a selectable symbol generator 24 for randomly generating symbols. In operation, the device 10 allows the user to play the poker-like game for a series of turns. In the preferred embodiment, for each user, the selectable symbol generator 24 generates a set of five randomly generated symbols which are displayed to the user by selectable display regions, as described below.

In generating such random symbols, each of the symbols, for example, may be assigned a unique number, and random number generating techniques known in the art may be used to generate random numbers from the set of unique numbers. For example, a random number generating method associated with a GNU C compiler available from the FREE SOFTWARE FOUNDATION may be used.

Using such random numbers, the corresponding random symbols may be generated therefrom. In addition, the random number generating techniques may be biased, such that a predetermined set of symbols have a predetermined probability of occurrence. For example, the symbol corresponding to a joker may be set to be generated once in every 10 rolls, while each symbol for a playing card may be set to be generated once in every 60 rolls. Such biased symbol generation enhances the play of the poker-like game.

In addition, the selectable symbol generator 24 may also be set to generate such random symbols, for each user, without repetition within any single turn, or alternatively without repetition within any single game session of each user. A game session is herein defined as a set of turns for a single player. Alternatively, repetition of symbols during a game session may be a option selectable by the user to further enhance playing of the poker-like game.

In a further alternative embodiment, the user may set the poker-like game to only generate symbols corresponding to standard poker playing cards, and accordingly to prevent generation of special symbols such as a joker, a devil, etc. With such a setting to generate only such symbols corresponding to a standard poker deck of cards, the selectable symbol generator 24 may have the probability of generating each symbol set to 1/52; i.e. each symbol corresponds to one unique card in a 52 card poker deck.

The processor 12 also includes selection means 26 to receive and process user inputs from the input device 16 to select a symbol to be displayed in a display matrix. Such user inputs may include signals generated by a mouse as the input device 16 to perform "drag-and-drop" operations known in the art. For example, the user may select a displayed symbol by "clicking" on the symbol using a cursor positioned thereupon, in a manner known in the art, and "dragging" the symbol; i.e. a graphical representation and/or replica, of the symbol to a specific position in the displayed matrix. The GUI 22 processes and performs such user inputs and display commands in a manner known in the art.

The processor 12 also includes poker hand determining means 28 for accessing the memory 18 to determine if a set of displayed symbols in the horizontal rows, vertical columns, or main diagonals of the displayed matrix correspond to a valid poker hand, as described below.

The processor 12 also includes a score generator 30 to generate a score of points awarded for attaining valid poker hands. The processor 12 may optionally include a chat room generator 32 for operating in a chat room mode for text transfer and receipt during multi-player operation, as described below.

The display 14 displayed a GUI screen or window which includes a graphically generated matrix 34 having columns and rows of display regions defining blocks. The display 14 also includes a set of selectable display regions 36, which display the set of five randomly generated symbols. A plurality of user actuatable icons 38 are also displayed, for example, a QUIT icon to quit the poker-like game, a SOUND toggle icon to toggle the generation of sound effects, and a CHAT toggle icon to toggle display of a chat room window.

The display 14 also displays specific display regions 40, such as a spin window and a points display window. The display may also optionally display a chat room window 42.

The memory 18 stores poker hand data 44 including a database 46 of valid combinations, such as combinations of symbols representing pairs, straights, flushes, etc. Alternatively, the poker hand determining means 28 may utilize a poker hand determining technique using classification methods known in the art to evaluate sets of symbols as representing pairs, straights, flushes, etc.

The memory 18 may also include a point table 48 for storing a predetermined set of point values associated with each valid combination of symbols representing poker hands. In a preferred embodiment, the following point schedule provides a balance between winning, losing, and strategically placing symbols to complete poker hands in each spin: 10 points for a pair; 20 points for two pair; 30 points for three-of-a-kind; 40 points for a straight; 50 points for a flush, i.e. all cards of the same suit; 80 points for a full house, i.e. one pair and a three-of-a-kind; 250 points for four-of-a-kind; 500 points for a straight flush; and 1000 points for royal flush. In an alternative embodiment, 2000 points may also be obtained for completely filling the matrix 34, but the goal of such complete filling may be disadvantageous in that a player may have to forego high scoring combinations, i.e. hands, in order to fill the entire matrix 34.

Figure 2:
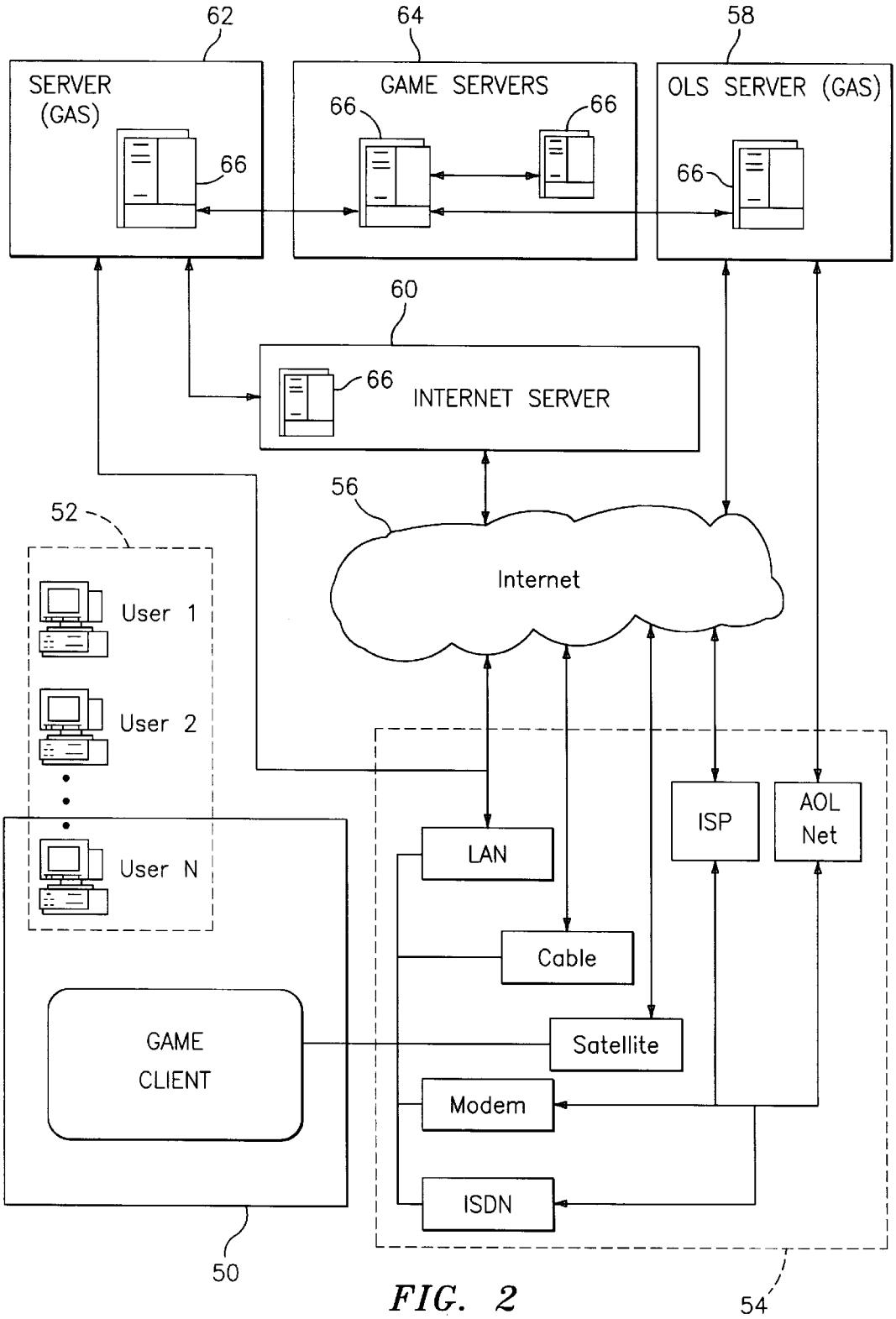
FIG. 2 is a schematic of the disclosed computer-based system using a network configuration for playing a poker-like game.

As shown in FIG. 2, for networked and/or multi-player operation, the disclosed computer-based system includes a game client 50 for interfacing with at least one user through user terminals 52. Each user terminal 52 may be the computer 10 shown in FIG. 1 or may be "dumb" terminals for on-line use. For example, such "dumb" terminals may merely process user inputs and receive and display data from the game client 50, with the processing capabilities for performing the poker-like game being located solely at the game client.

Referring to FIG. 1, the communications interface 20 may include a 14.4 Kbaud modem operatively connected to the processor 12 through at least one port, such as a serial port, with the modem connected to outside telephone lines to the network through the game client 50. The communication interface 20 may operate in conjunction with other hardware and/or software included in the device 10, such as on-line interface software or Internet software available from an on-line service (OLS) such as "AMERICA ON-LINE", or from an Internet service provider (ISP) such as "THE MICROSOFT NETWORK", in which the Internet is a network of computer networks linked by telephone lines, leased lines, fiber optic cables, and copper wires; and including at least five million host computers which are accessed daily by about twenty million people world-wide. The Internet also includes gateways to OLSs as well as graphic and multimedia portions such as the World Wide Web (WWW), E-mail facilities, and file transfer protocol (FTP) and CGI facilities.

The disclosed computer-based system includes network connections 54 including, but not limited to, a modem or an integrated services digital network (ISDN) connection to an OLS network; a T1 line, a coaxial cable connection to a cable system interface and/or a cable modem, a local area network (LAN) or other networks such as a wide area network (WAN) or medium area network (MAN), a satellite link, or an ISP connection to the Internet 56. The game client 50 may be connected through an OLS or through the Internet to an OLS server 58.

Such OLS servers 58 may be E class Hewlett Packard (HP) machines using a PA RISC CPU and having about 256 MB of RAM, a 1 GB hard drive, and a fiber optic network interface card such as FDDI, and utilizing an HPUNIX v.9.05 operating system.

Alternatively, the game client 50 may be connected through an Internet server 60 to a proprietary server 62. In another alternative embodiment, the game client 50 may be connected through the LAN connection directly to the proprietary server 62. Such LANs may be implemented in a casino, a boat, an airplane, a restaurant, a space station, etc.

The OLS server 58 and the proprietary server 62 are connected to a set of game servers (GAS) 64 which manage a plurality of concurrent single player and/or multi-player games. Each of the servers 58–64 includes a respective server processor 66 having appropriate server hardware, software, and interfaces for providing the appropriate communication protocol for establishing a connection between the users 52 and the set of game servers 64.

Figure 3:
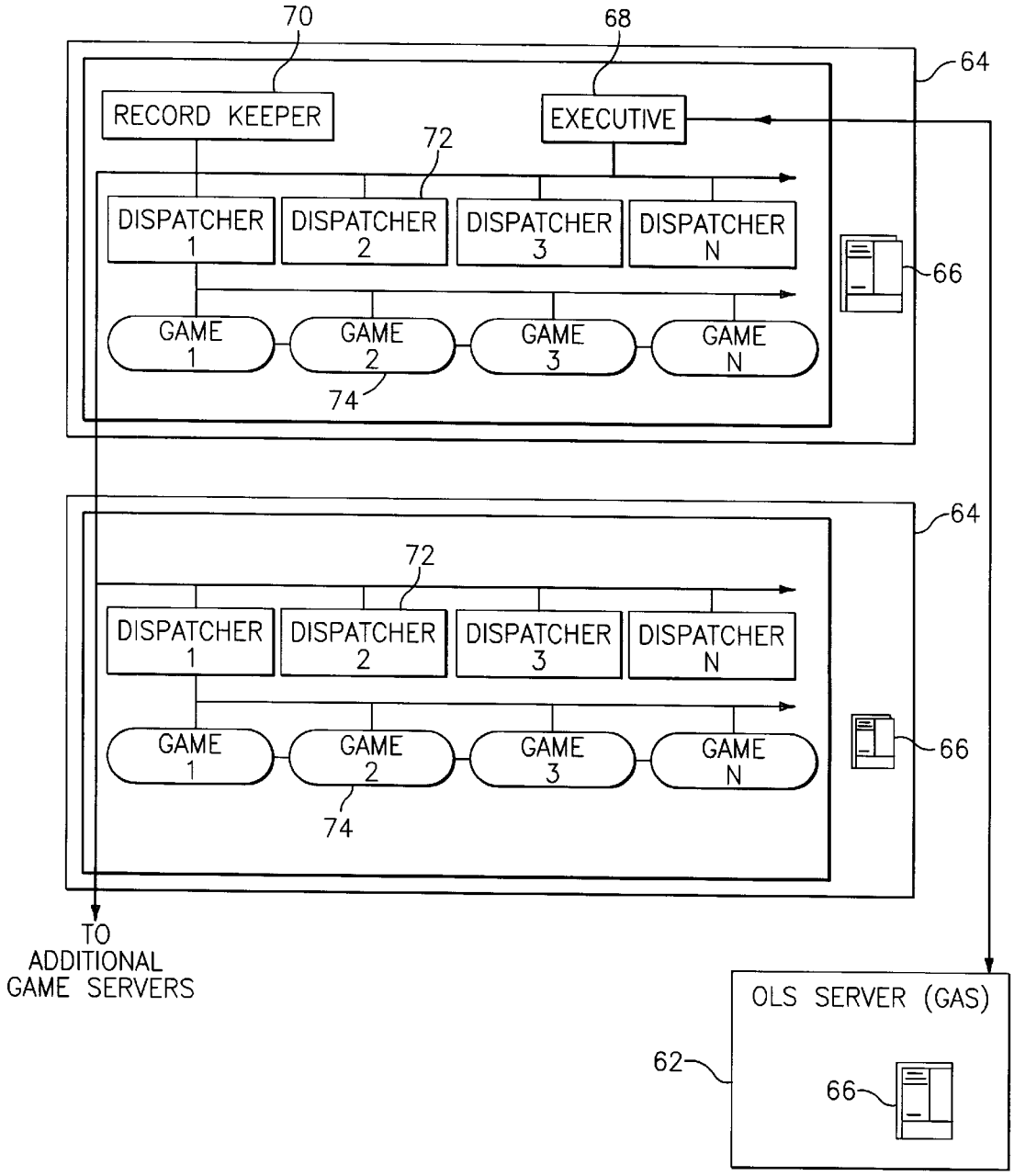
FIG. 3 is a schematic of a game server.

In a preferred embodiment, as shown in FIG. 3, the set of game servers 64 includes the server processor 66 for controlling an executive function 68, a records keeper function 70, and a plurality of dispatcher modules 72, with each dispatcher module interfacing with a plurality of software modules each operating the poker-like game 74 for a respective user. As shown in FIG. 3, one of the set of game servers 64 may be connected to an OLS server 62 and to other game servers to perform as a primary game server for maintaining the executive function 68 and the record module 70 which coordinate operations of all of the set of game servers 64.

Figure 4:
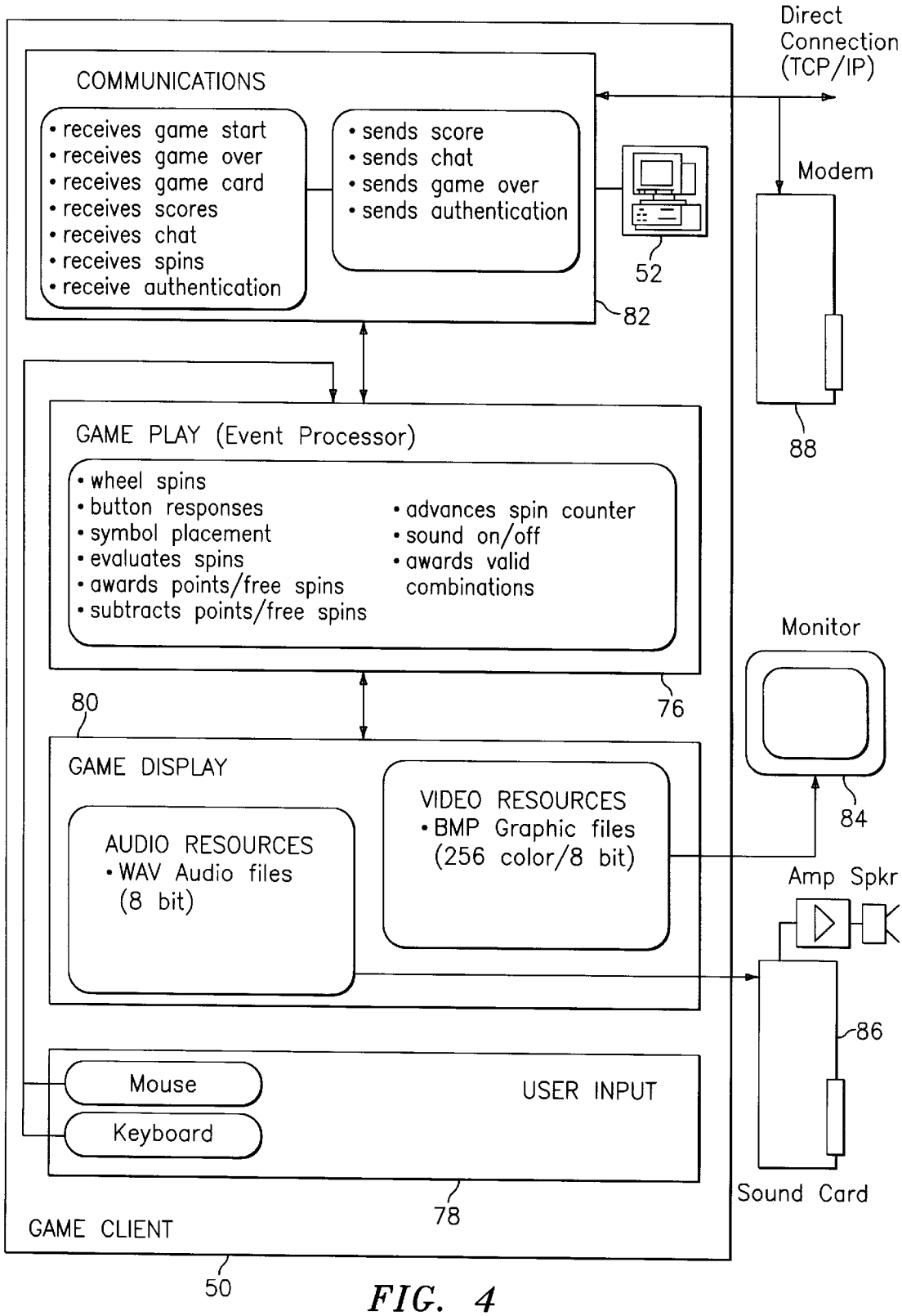
FIG. 4 is a schematic of a game client.

As shown in FIG. 4, the game client 50 includes an event processor 76 connected to a user input device 78, a game display 80, and a communications interface 82. The event processor 76 operates the application program for allowing the user to play the poker-like game. The event processor 76 performs wheel spins; i.e. the event processor 76 operates the selectable symbol generator to generate a new set of five random symbols and to change a current display of the selectable display regions to display the generated random symbols to simulate the spinning of multiple mechanical wheels generating random symbols as in slot machines in the prior art.

The event processor 76 also generates button responses; i.e. the processing of actuations of user-actuated icons. The event processor 76 also performs symbol placement; i.e. the event processor responds to user selections of the selectable display regions to place a symbol into the matrix 34, for example, by dragging and dropping a graphic depiction of the selected symbol to a specific matrix display region. The event processor 76 also evaluates spins; i.e. the actuation of an actuation icon to generate the new set of five random symbols to determine, for example, whether the special symbols for a joker, for a devil, for a free spin, or for a gold coin are generated.

In response to evaluating spins, the event processor 76 awards or subtracts points and/or free spins as appropriate, for example, for the substraction of points due to a devil symbol being generated, or for the awarding of points from the selective placement of symbols on the matrix 34 to generate a valid poker combination.

The event processor 76 also awards valid symbol combinations; i.e. corresponding to poker hands, as well as the occurrence of a special events; for example, the filling up of the entire matrix 34 with symbols, which causes bonus points to be added. In response to user inputs, the event processor 76 also advances a spin counter and toggles sound to be on or off.

The user input 78 of the game client 50 may also include a mouse or keyboard, as well as signals remotely received from a mouse or keyboard of the users using the user terminals 52.

The game display 80 of the game client 50 provides video resources, such as predetermined graphics files, for example, as bit-map (BMP) and GIF files, to provide 256 color and 8 bit images for use in the GUI to display, for example, the various playing card symbols as well as the special symbols, such as the joker and the gold coin, on a monitor 84. The game display 80 may also include audio resources such as 8 bit WAV audio files to generate game sounds through a sound card 86 connected to the speaker and/or amplifier of each of the user terminals 52. Such game sounds may include predetermined background music, a gold coin spilling sound which is generated and output in response to the generation of a gold coin symbol in the new set of selectable symbols, or a flipping sound as the new set of selectable symbols are generated and displayed in the selectable display regions, to simulate movement of cards or wheels as in slot machines of the prior art.

The communications module 82 performs communication protocols between the event processor 76 and the game servers 64 through, for example, a direct connection 88 such as a TCP/IP connection or a modem. The communications module 82 receives control and data signals corresponding to the start of a game session; to the end of a game session; and to the generation of a game card, i.e. the transition at the beginning of the game from an introductory screen and/or chat room window to the matrix 34. The received control and data signals may also include received chat signals, i.e. data corresponding to text from other users in a chat room mode; signals indicating the number of spins/turns played by each user; and received authentication signals, for example, in security and/or pay-to-play configurations.

The communications module 82 also provides the appropriate protocols to send the current score of each user to the game server, for example, to maintain a high score table; to send chat signals, i.e. data corresponding to text from a user to other uses in a chat room mode; to send a game termination signal from a user to quit the game; and to send an authentication signal to verify the user, for example, in security and/or pay-to-play configurations.

Figure 5:
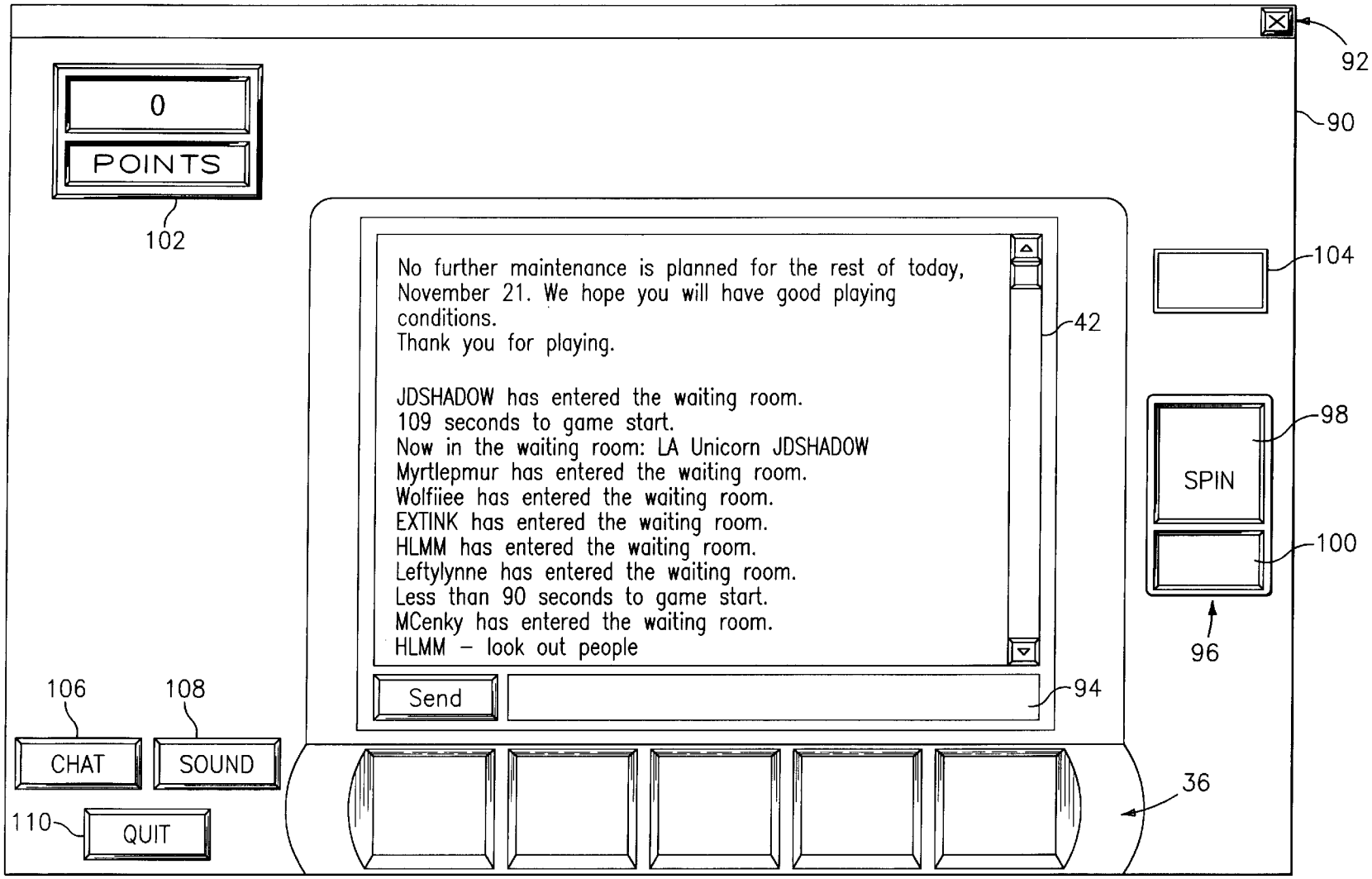
FIG. 5 is a display screen including a large chat room window.

As shown in FIG. 5, in both the stand-alone configuration for single player use shown in FIG. 1 and the multi-player configuration shown in FIGS. 2–4, the computer-based system and method generates an introductory game screen 90 on the display 14 using the GUI 22. The introductory game screen 90 displays a command bar 92, the selectable display regions 36, and the chat room window 42 which displays introductory messages such as THANK YOU FOR PLAYING or, in the multi-player configuration, announcements of individuals entering a queue of players in a "Waiting Room", as the computer-based system initializes the poker-like game.

In the multi-player configuration, the chat room window 42 includes a text entry region 94 which displays text entered by a user. Upon activation; i.e. "clicking", the SEND icon, the entered text is sent to be displayed in the stream of chat room text shown in the chat room window 42.

The specific display regions 40 of FIG. 1 include, for example, a spin window 96 which has an actuatable spin icon 98 and a turn indicator 100 which displays the current turn number. The specific display regions 40 also include a point indicator 102 for displaying the current number of points awarded to the user at the end of a current turn, and a time indicator 104 for indicating a countdown of time remaining for a user to make a selection of a symbol from the selectable display regions 36 to be placed; i.e. graphically replicated, in the matrix 34.

The user actuatable icons 38 of FIG. 1 include, for example, a chat room toggle icon or CHAT icon 106 for activating and deactivating the display of the chat room window 42; a sound toggle icon or SOUND icon 108 for activating and deactivating the sound effects generated by the computer-based system and method during the game; and a game termination icon or QUIT icon 110 for allowing the user to quit the current game.

Figure 6:
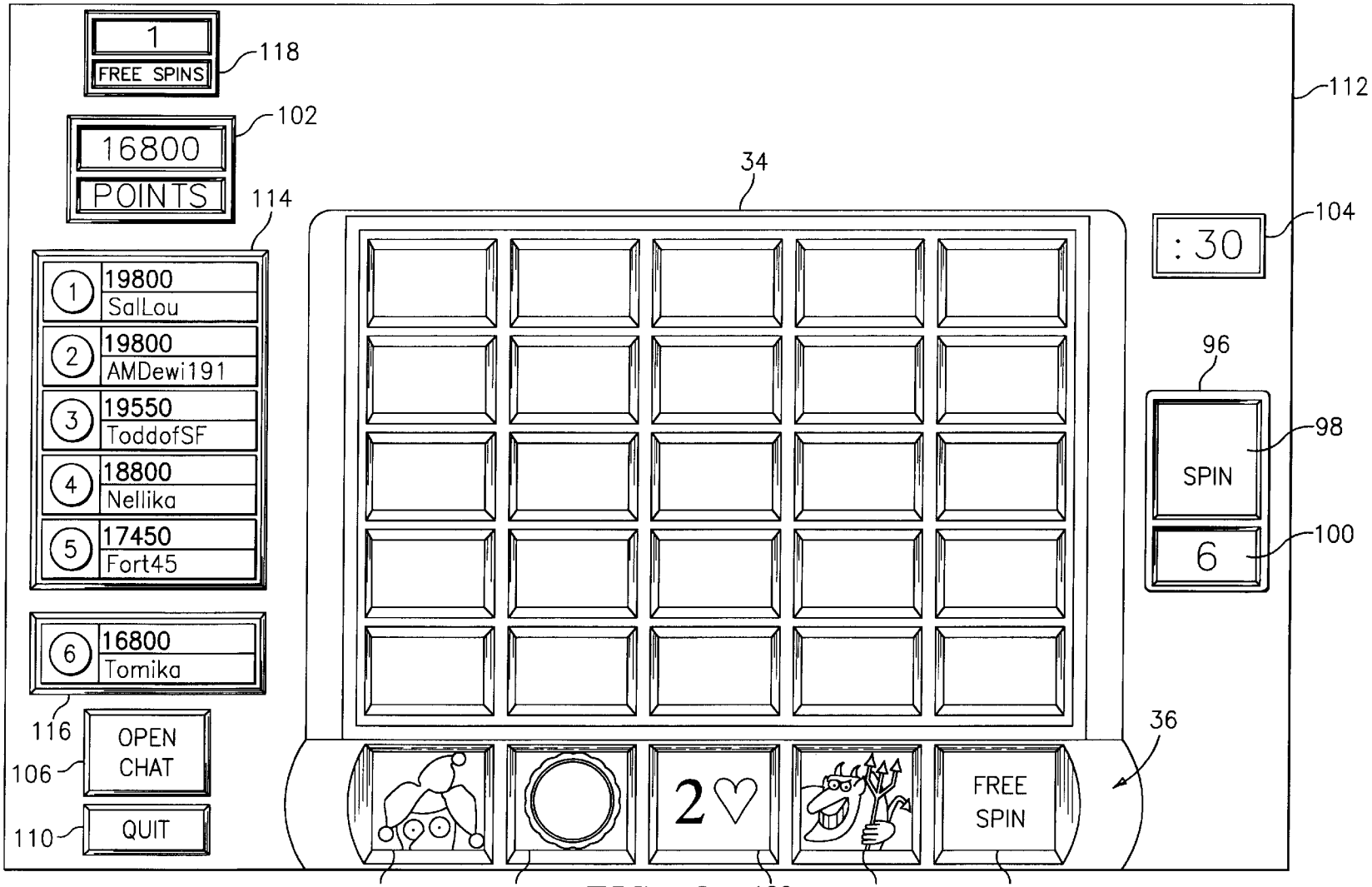
FIG. 6 is a display screen for playing the poker-like game.

After the poker-like game has commenced, the matrix 34 and other specific display regions 40 are displayed on an active game screen 112, as shown in FIG. 6. The active game screen 112 differs from the introductory game screen 90 in FIG. 5 in that the chat room window 42 is replaced by the matrix 34, and, in a multi-player configuration, the current scores of all of the players are displayed in a multi-player high score window 114. If the current score of the user viewing the active game screen 112 is less than the scores of a predetermined number of higher ranking scores, then the current score of the viewing user is displayed in a separate viewer score window 116. For example, the disclosed computer-based system may accommodate twenty players in a single game session, and the scores of all of the players are ranked, with only the scores of the top five players being displayed in the high score window 114.

Figure 8:
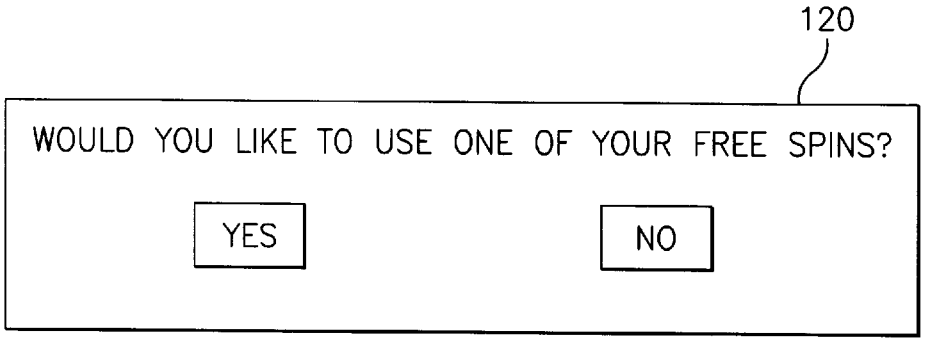
FIG. 8 is a query window.

At the beginning of each turn, if the user viewing the active game screen 112 has earned at least one free spin, the number of free spins is displayed in a FREE SPIN count window 118, and a separate query window 120, for example, as shown in FIG. 8, is displayed overlapping the active game screen 112 to request the viewing user to choose whether to use a free spin, and to enter the choice through the query window 120.

As shown in FIG. 6, after activation of the spin icon 98, the selectable symbol generator 24 generates five random symbols, such as a playing card icon 122, for example, a two of hearts, and icons including the special symbols, such as an unused joker icon 124, a gold coin icon 126, a devil icon 128, and a free spin icon 130. Such random symbols are then displayed in the selectable display regions 36.

Within the time limit of, for example, thirty seconds, as counted down by the processor 12 and displayed in the time indicator 104, the current viewing user is to select at least one of the displayed symbols in the selectable display regions 36 or lose the current turn.

Figure 7:
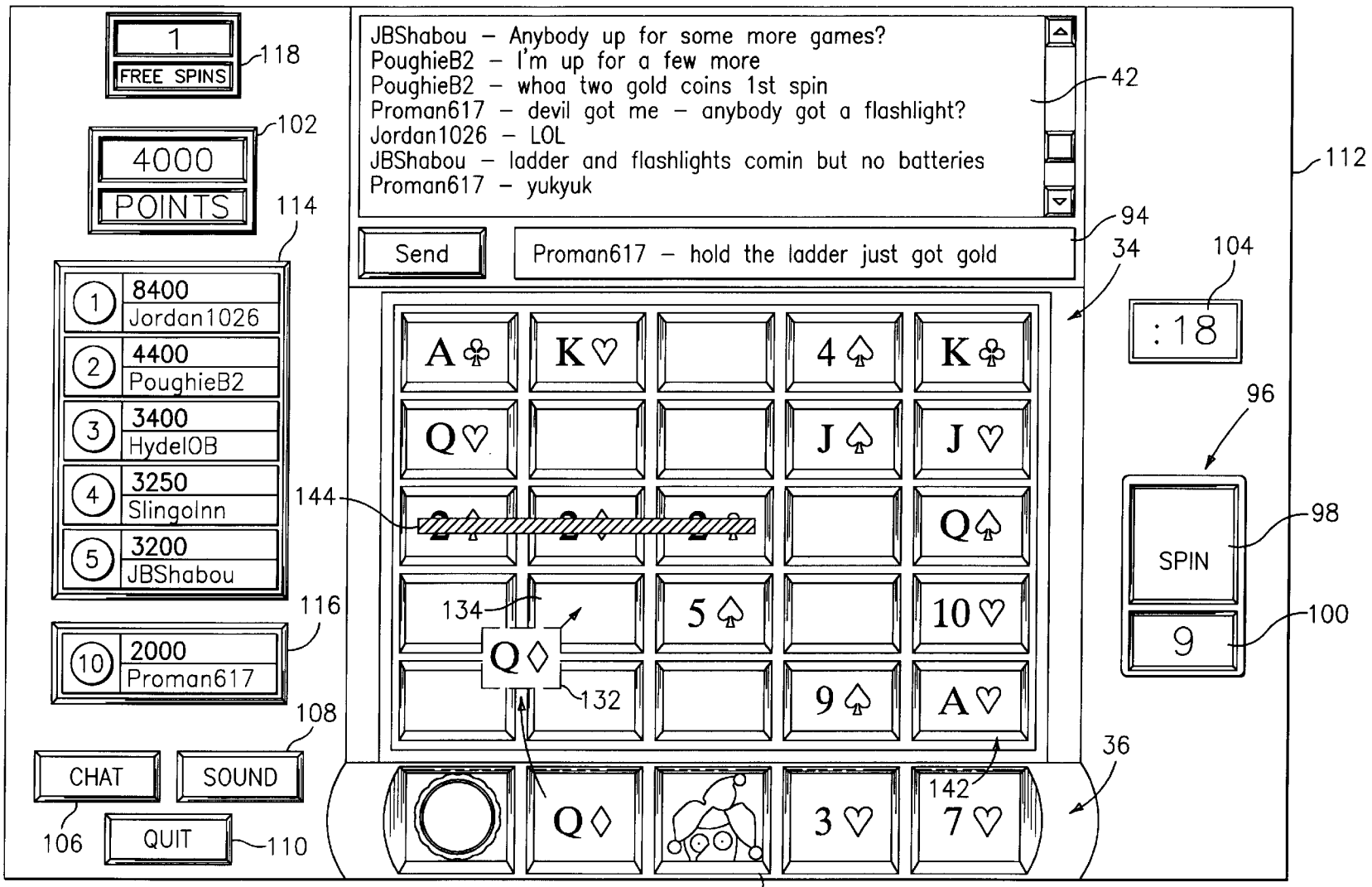
FIG. 7 is an alternative display screen including a small chat room window for playing the poker-like game.

As shown in FIG. 7, a selection has been made of a queen of diamonds in the selectable display regions 36, with a graphic replica 132 of the queen of diamonds icon (shown in phantom) being "dragged and dropped" to a target display region 134 in the matrix 34. That is, in response to user inputs through the input device 16 and the GUI 22 corresponding to the selection of a selected symbol graphically displayed in the selectable display regions 36, the selection means 26 of the processor 12 causes the GUI 22 to generate and display the graphic replica 132 of the selected symbol being moved from the selectable display regions 36 to the target display region 134. The selection means 26 then instructs the GUI 22 to change the target display region 134 to display the selected symbol. The selection means 26 may be embodied as a software routine using GUI and "WINDOWS" graphical processing known in the art.

Figure 9:
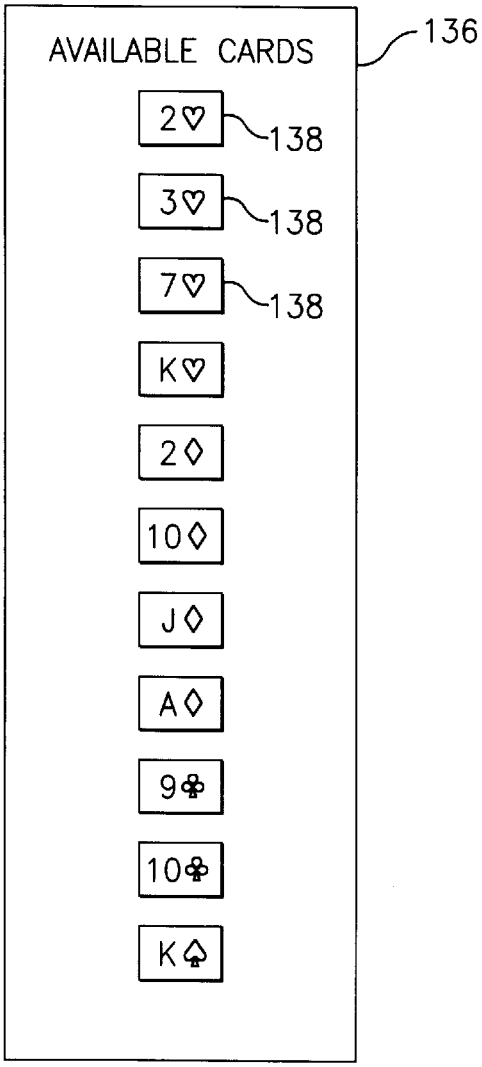
FIG. 9 is a selection menu for choosing an available card.

The disclosed computer system and method also processes a user selection of the unused joker icon 124 in FIG. 6 to generate a menu 136 of selectable symbols 138, as shown in FIG. 9, with the menu 136 being displayed to overlap the active game screen 112. In response to a user selection of one of the selectable symbols 138, the disclosed computer-based system generates a graphical replica of the selected symbol for "dragging and dropping" as described above. After such "dragging and dropping", the disclosed computer system then changes the unused joker icon 124 such as shown in FIG. 6 to a used joker icon 140 as shown in FIG. 7, to indicate that the joker feature has been used. During some turns, more than one joker symbol may be generated and displayed in the selectable display regions 36, so different joker icons 124, 140 are used to indicate unused and used jokers, respectively.

In an alternative embodiment, the user may also remove and/or move previously placed symbols displayed in the matrix 34; i.e. the user may alter the currently displayed symbols in the matrix 34 before the end of the turn; i.e. within the thirty second time limit. Such flexibility in symbol/card placement provides for strategic trade-offs as well as enhanced and more enjoyable play.

After placement of all selectable icons, as shown in FIG. 7, poker hand determining means 28 of the processor 12 evaluates the symbols displayed in the matrix to determine any valid poker combinations and any points awarded therefrom to be displayed in points indicator 102 and added to the current score of the viewing user, using the score generator 30, displayed in the score windows 114–116. For example, the fifth column 142 depicts a straight, so, for example, 40 points are awarded for the combination in the fifth column of the matrix 34.

Alternatively, the poker hand determining means 28 may determine a valid poker combination and graphically and/or audibly indicate such a combination. For example, a continuous bar 144 may be displayed overlapping the valid combination, such as the three-of-a-kind of twos of spades, diamonds, and clubs shown in FIG. 7. Alternatively, the display regions corresponding to the valid poker combination may flash, blink, or otherwise change appearance either temporarily or permanently during a single game turn or during the remaining game session.

The audible indication of the valid combination may be a predetermined tingling sound generated by the processor 12, for example, using a sound card and WAV files, as described above. Such audible indications may be deactivated by toggling the SOUND icon 108.

Activation of the CHAT icon 106 during play, with the active game screen 112 being displayed, causes the chat room window 42 to be displayed with a text entry region 94, as shown in FIG. 7, for example, with smaller dimensions than in the introductory game screen 90 in FIG. 5. Subsequent activation of the CHAT icon 106 toggles the chat room window 42 to close, with the CHAT icon 106 modified to have the indicia OPEN CHAT, as shown in FIG. 6, to open the chat room window 42 upon activation, as shown in FIG. 7.

In operation, in a preferred embodiment, the disclosed computer system may be initialized for operating the poker-like game in a standard poker deck mode; i.e. the selectable symbol generator 24 is set to generate only a standard poker deck of fifty-two unique symbols, and to not generate the special symbols such as the joker, the devil, the gold coin, or the free spin icon, as described above.

The disclosed computer system generates a blank matrix 34; i.e. all twenty-five display regions of five rows and five columns are displayed. The selectable symbol generator 24 then generates one set of five cards; i.e. symbols, for each of five turns, with each set of five cards being randomly generated to simulate a shuffled deck. In the preferred embodiment, repetition of cards/symbols does not occur. During each of the five turns, each set of five cards is displayed in the selectable display regions 36, and, during the turn, the user places each card in the matrix 34 by clicking on the corresponding symbol in the selectable display regions 36. The user then drags and drops a replica of the selected card/symbol to a chosen one of the display regions in a corresponding column in the matrix 34, as described above with reference to FIG. 7. The goal of selecting and then dragging and dropping such cards/symbols is to display such cards/symbols in the matrix 34 to form as many valid poker hand combinations as possible, and preferably higher scoring poker hands, in order to increase the final score at the end of the five turn session.

After the dragging and dropping a card/symbol to be displayed in a corresponding column in the matrix 34, the corresponding selected card/symbol in the selectable display regions 36 is blocked out, or alternatively, the appearance of the selected card/symbol in the selectable display regions 36 is modified to indicate that such card/symbol has been selected and may not be selected again.

The end of a given turn may be indicated by placement of the fifth card of a given set during the given turn in the matrix 34, which causes the disclosed computer system to automatically go to the next turn to generate the next set of five selectable symbols, or, after the fifth turn, to the end of the five-turn game session as described below. Alternatively, the end of a turn may be indicated by the user actuating the SPIN icon 98 to go to the next turn.

At the end of each turn, the disclosed computer system, using the poker hand determining means 28 in conjunction with the valid combinations 46 stored in the memory 18, determines if any valid poker hands have been generated during the turn. If so, the score generator 30 in conjunction with the point table 48 stored in the memory 18 generates the current points awarded for the turn and updates the score of the user displayed in the score windows 114–116.

After the five turns of placing each of the five sets of five cards/symbols in the matrix 34, the entire matrix 34 of twenty-five display regions is filled, and the final score of the user is generated and displayed. In the preferred embodiment, the user obtains credit; i.e. points, for the best poker hands. As each turn progresses and the user displays valid poker hands, the user may use previously displayed poker hands to make new poker hands. For example, in one turn, the user may display a pair of jacks in the matrix 34 and obtain the appropriate points for a pair, and then in a subsequent turn, a third jack may be placed adjacent to the pair of jacks previously displayed to generate a three-of-a-kind. However, in the preferred embodiment, the user receives the difference in points between a three-of-a-kind and a pair, since the user is only credited for the three-of-a-kind. Accordingly, the disclosed computer system may generate the difference in points and then add the difference to the current score of the user for the subsequent turn. Alternatively and equivalently, the disclosed computer system may deduct the previously awarded points for the pair from the total score, and then add the appropriate points for the three-of-a-kind to the total score.

In an alternative embodiment, the user may receive credit for every valid poker hand, in which each valid poker hand displayed by the user, including new poker hands generated by adding cards/symbols to previously displayed poker hands, is awarded the appropriate points without deduction of points associated with any previously displayed poker hands.

During each turn, disclosed computer system displayed the current score for the turn of the user viewing the active game screen 112 in the points indicator 102, as shown in FIGS. 6–7. The disclosed computer system also displays the total score of the viewing user in conjunction with the scores of other users in a multi-player game session using the score windows 114–116, so that the viewing user may see how the viewing user stands compared to the other users, which enhances the play and the enjoyment of the game.

Accordingly, in the preferred embodiment, the disclosed computer system and method allow a user to play five turns of standard poker; i.e. using only the cards/symbols corresponding to the standard deck of fifty-two poker cards. In the preferred embodiment, the special symbols and features such as the joker, the devil, the gold coin, and the free spin are disabled.

Figure 10:
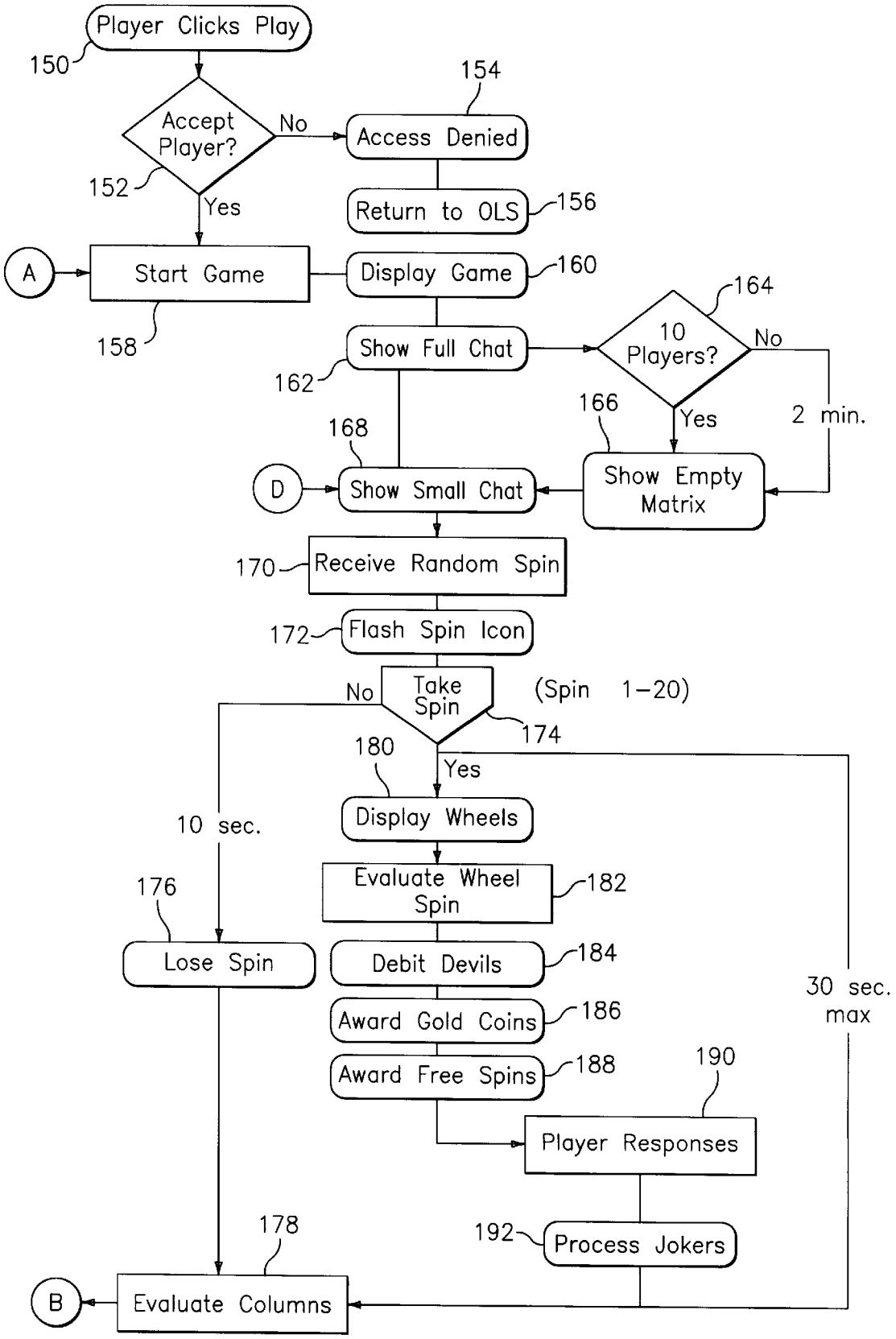
FIGS. 10–12 are flowcharts of the disclosed method for implementing the computer-based poker-like game.
Figure 11:
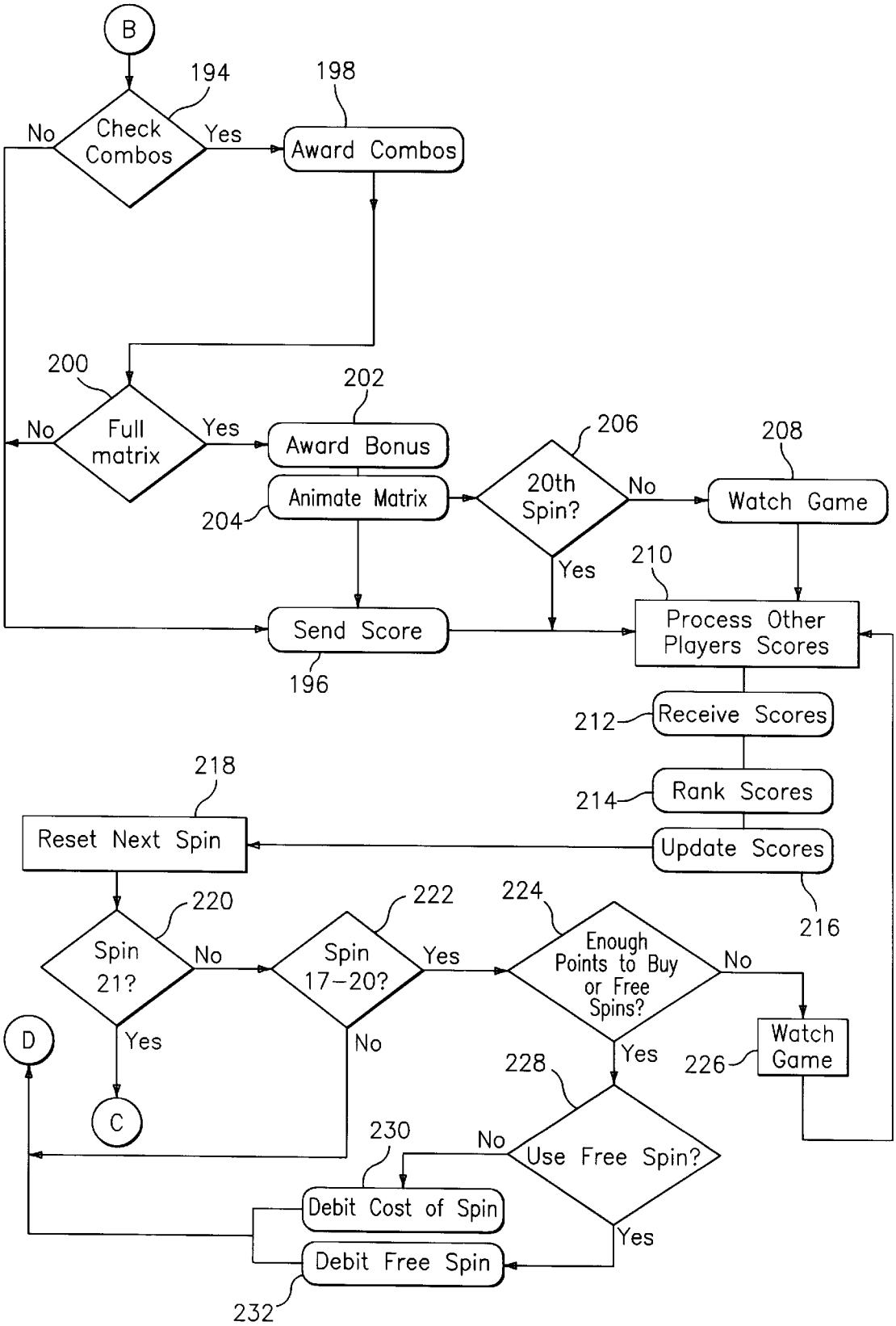
Figure 12:
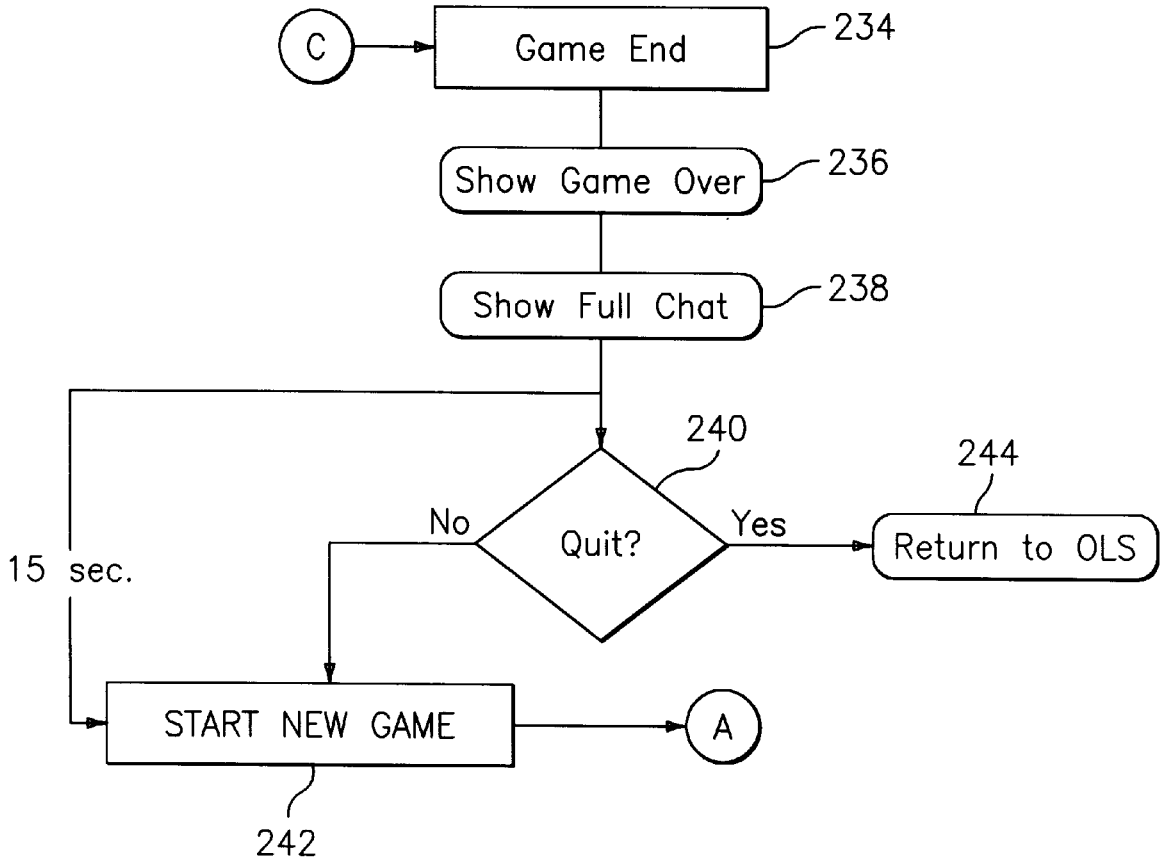

In an alternative embodiment, in operation, the disclosed computer-based system operates according to the method shown in FIGS. 10–12 to implement the poker-like game described above and having the special symbols and features such as the joker, the devil, the gold coin, and the free spin enabled. In this alternative embodiment, the disclosed computer system and method operate to implement a poker-like game in a manner similar to the game systems and methods for playing a bingo-like game as described in commonly assigned pending U.S. patent applications having application Ser. No. 08/614,322, filed Mar. 12, 1996, now Pat. No. 5,647,798 dated Jul. 15, 1997 and entitled "METHOD AND APPARATUS FOR PLAYING BINGO ON A SLOT MACHINE", and application Ser. No. 08/848,505, filed Apr. 28, 1997 and entitled "COMPUTER-BASED METHOD AND APPARATUS FOR PLAYING A BINGO-LIKE GAME", each of which is incorporated herein by reference.

Hereinafter, the method of the disclosed computer-based system in this alternative embodiment is described with reference to operation of the multi-player configuration using the components shown in FIGS. 2–4. It is to be understood that the disclosed computer-based system for playing the poker-like game may be operated for a single user and/or with a stand-alone computer such as a personal computer and as described above with reference to FIG. 1. Accordingly, the method shown in FIGS. 10–12 may be adapted for operation with a single user; for example, by disabling and/or removing the various steps directed to multi-player operation.

Initially, the user activates a computer to be used in the disclosed computer-based system, which displays a pre-game screen (not shown) generated by an OLS, which includes an activation icon, such as an icon labelled PLAY, to initiate the game. After the player clicks PLAY in step 150, the method decides in step 152 whether to accept the player; for example, players may require to enter a password and/or to use an encrypted token for verification of membership to a subscription service and/or may have to pay to play. Other access procedures may include parental controls to prevent minors from using the poker-like game, since the awarding points and the multi-player competition may be perceived as gambling.

If access is denied in step 154, the player is returned to the OLS. Otherwise, the method starts the game in step 158, and displays in step 160 the introductory game screen 90 shown in FIG. 5. The method also shows the full chat room window 42 in step 162, and waits in step 164 either for ten players to enter the "waiting room" queue or for two minutes to pass before starting the game session with the queued players.

Hereinafter, the described method refers to a single player using the disclosed computer-based system and method operating in a multi-player mode to conduct a multi-player game; however, it is understood that, in the multi-player game, the method performs the steps with respect to each player and operates multiple game sessions concurrently, with each game session performed independently for each player.

The method then generates and displays an empty matrix 34 in step 166, as shown in FIG. 6, and may, by default, display in step 168 the small chat room window as shown in FIG. 7. The method then optionally performs a first spin for the first turn only; i.e. generates in step 170 a set of five random symbols using the selectable symbol generator 24 for illustrative purposes only to the player, as the selectable display regions 36 are initially blank. Accordingly, the method may optionally simulate an actual slot machine which typically always displays a set of wheels or symbols, including at the beginning of the game.

The method then flashes the spin icon 98 in step 172; i.e. changes the appearance and/or color of the spin icon 98 and/or displays new text such as NEXT TURN or SPIN NOW. The player then has ten seconds to take a spin in step 174. If the player does not activate the spin icon 98, the player loses the spin and thus the turn in step 176, and the current matrix 34 is evaluate in step 178, as described below.

If the player takes a spin in step 174, the selectable symbol generator 24 generates a current set of five symbols for display in step 180 in the selectable display regions 36. In a preferred embodiment, each player in the multi-player configuration receives a unique set of five randomly generated symbols in step 180. In an alternative embodiment, every player in the multi-player configuration receives an identical set of five randomly generated symbols.

The method then evaluates the current wheel spin in step 182 to determine whether any devils, gold coins, free spins, or jokers have been displayed. The method then proceeds to debit devils in step 184, which may include clearing to zero or, alternatively, halving the entire score of the player; i.e. the score generator 30 modifies the score appropriately in response to the generation of a devil symbol 128.

The method then awards the player for any gold coins in step 186; i.e. a predetermined amount of points, such as 1000 points, are added to the current point total displayed in the point indicator 102. The method also awards any free spins to the player in step 188 by incrementing the free spin indicator 118. The method then processes player responses in step 190; i.e. inputs through the GUI 22 to "drag and drop" any poker card symbols to the matrix 34, such as illustrated in FIG. 7 for symbol 132 placed in the target display region 134 of the matrix 34. The method then processes jokers in step 192 to generate a menu 136 of available symbols 138 as in FIG. 9.

The player has a preset maximum time to respond to the spin generated in step 180 to perform steps 180–192. For example, steps 180–192 are to be performed within thirty seconds. Since the method is computer-based, step 180–188 are typically performed in less than about two seconds, so the majority of the response time is borne by the player in steps 190–192. If the time limit is not met, as shown in the time indicator 104 which counts down to zero, the player is prevented from processing any unprocessed symbols or jokers, and the method proceeds to step 178. The maximum response time of about thirty seconds presents a challenge to the player to process the symbols and jokers rapidly, which enhances play of the poker-like game.

In performing step 178, the method evaluates all symbols displayed in the matrix 34 using the poker hand determining means 28 and the score generator 30. The method proceeds to step 194 to check for any valid poker hand combinations using the poker hand determining means 28 and the database of valid combinations 46 as described above. If there are no new valid combinations detected in step 194, the method proceeds to step 196 to update the score of the current player using the score generator 30 and to send the score in step 196 for display to all players.

If there are valid combinations detected in step 194, the method generates corresponding points for each valid combination using the point table 48 in step 198, and also updates the point indicator 102. In a preferred embodiment, as new combinations of symbols are made from old combinations shown in the matrix 34, the points generated for the old combinations are deducted from the points generated for the new combination. That is, the player only gets credit for the highest poker hand combinations attained.

The method then determines if the entire matrix 34 is filled with symbols in step 200. If not, the method ends the turn and sends the current points for the turn to the score generator 30 to generate and send the current score to all players in step 196. Otherwise, for a full matrix 34 detected in step 200, a bonus of, for example, 2000 points is awarded in step 202 and the point indicator 102 is incremented accordingly. The method then animates the matrix 34 in step 204; i.e. the appearance and/or colors of the matrix are changed to flash.

The method then ends the turn and the updated total points for the turn is sent to the score generator 30 in step 196. The method also detects whether the last turn ended in step 206 was the $20^{TH}$ turn of the player. If not, the player must wait and watch the game in step 208 until all other players are finished with their current turn and the method proceeds to step 210. Otherwise, if the player has finished the $20^{TH}$, the player is finished with the game session after step 206, and the method then proceeds to step 210, in which the scores of all other players are processed.

The user terminal 52 of a current user then receives the scores of the other players in step 212, ranks such scores in step 214, and updates the scores in step 216 to display such ranked scores in the score windows 114–116.

The method then resets the user terminals 52 for all players in step 218 by incrementing by one a spin count stored the memory 18 to be displayed in the spin or turn indicator 100. If the incremented spin count equals 21 as determined in step 220, the incremented spin count is not displayed by the turn indicator 100, and the method proceeds to end the game in step 234. Otherwise, the method determines whether the spin count is within the range of 17–20 in step 222.

If not, then the spin count is less than 17, and so the method proceeds to step 168 to repeat steps 168–222 for additional turns. Otherwise, if the spin count is within the range of 17–20, the method determines whether each player has any free spins and/or enough points in the total score of the player to "buy" additional spins in step 224. The fee schedule for additional spins may be, for example, 500 points for spin 17, 1000 points for spin 18, 1500 points for spin 19, and 2000 points for spin 20. Such a fee schedule may be displayed to the user, and the user may also be queried whether to purchase such additional spins.

If the player cannot buy additional spins and does not have any free spins, the game session of the player ends, and the player is relegated to watching the game in step 226; i.e. the scores of the other players are updated for spins 17–20 and displayed to the relegated player.

If the player has free spins or enough points to buy additional spins, the method queries the player in step 228 whether or not to use a free spin, using the query window 120 shown in FIG. 8. If the player chooses not to use a free spin, the cost of the spin is debited in step 230 from the score of the player displayed in the score windows 114–116. Otherwise, the choice of the player to use a free spin causes the number of free spins to be debited from the free spin indicator 118 in step 232.

It may be advantageous to not use free spins and to purchase additional spins in turns 17–19 in order to save any free spins which a user may have, as indicated by the free spin indicator 118, in order to avoid purchasing the higher costing spins in turns 18–20, and to thus maximize the score by reducing the amount debited. After steps 230–232, the method proceeds to step 168 to repeat steps 168–220 for turns 17–20.

After turn 20 is attained by all players, which is detected in step 220, the method proceeds to end the game session in step 234, by displaying a GAME OVER message in step 236, and generating the full chat room window 42 as shown in FIG. 5 in step 238. In an alternative embodiment, after step 236, the method may display a list of highest scores recorded for different time frames, such as within the last month or within the last year.

The method then queries each player whether to quit playing the poker-like game in step 240. If a player chooses not to quit in step 240 or does not respond for a predetermined response time, such as 15 seconds, the method starts a new game in step 242 and proceeds to step 158.

Otherwise, upon a player choosing to quit the poker-like game, the method returns the player to the OLS in step 244.

It is to be understood that the option to quit may always be provided to the player, concurrently with the game session and during any turn, through the display of the actuatable QUIT icon 110, or alternatively through implementation of other icons on a taskbar or of a predetermined set of keys or hotkeys using a keyboard and/or a mouse which end the game session upon actuation.

In addition, as described above, the chat room features may be toggled and used concurrently with the game session and during any turn. For example, during steps 174–192, if a player has completed processing symbols before the thirty second time limit, the player may engage in entering and send and/or reading text in the chat room window 42.

While the disclosed computer-based system and method have been particularly shown and described with reference to the preferred embodiments, it is understood by those skilled in the art that various modifications in form and detail may be made therein without departing from the scope and spirit of the invention.

As will become readily apparent to those skilled in the art, the matrix 34 may be a series of television screens for displaying symbols within each block, a single screen subdivided into blocks for displaying symbols, individual display screens per block, or other display systems as would be found on slot machines, video games, computer systems, and the like.

The disclosed computer-based system may also be configured with input devices simulating a slot machine activating arm and coin slot as would be typically found in a slot machine for playing poker in the prior art. Further, the input devices may be trackballs or other pointing and GUI devices, and the selectable display regions may include LED or LCD displays, which may be fixed in a housing or mounted on the spinning wheels of a slot machine.

In addition, the multi-player networked configuration may involve distributed communication systems in hybrid forms for interactive TV and cable implementations. Further, the game screens 90 and 112 may be adapted for displaying advertisements, including animated advertisements, as well as other information, such as TV and cable broadcasts.

Accordingly, modifications such as those suggested above, but not limited thereto, are to be considered within the scope of the invention.

What is claimed is:

1. A device for playing a poker-style game comprising:

an input device for receiving user inputs;

a display for displaying a graphic user interface (GUI) including:

a five column by five row display matrix, wherein each column and row combination includes a matrix display region defining a block of the display matrix;

five selectable display regions, each selectable display region corresponding to each column of the display matrix; and a plurality of user-actuatable icons, including an actuation icon; and a processor, responsive to the user inputs, for executing an application program to cause the display of the GUI, the processor including:

a selectable symbol generator, responsive to the user inputs corresponding to actuation of the actuation icon by the user, for randomly generating a set of selectable symbols corresponding to poker playing cards for display by the selectable display regions;

selection means for causing a selected symbol displayed by the selectable symbol generator in at least one of the selectable display regions to be displayed in a selected matrix display region of the display matrix; and determining means for determining whether the display matrix displays a combination of symbols corresponding to a poker hand condition, and for generating a poker hand indication signal for indicating the poker hand condition.

2. The device according to claim 1 wherein the processor further includes:

a matrix symbol generator for generating and displaying symbols corresponding to poker playing cards for display by the matrix display regions of the display matrix; and wherein the selection means, responsive to user inputs, causes the matrix symbol generator to display the selected symbol in a selected matrix display region of the display matrix.

3. The device according to claim 1 further comprising:

a memory, accessible by the determining means, for storing poker hand data corresponding to a plurality of combinations of symbols, each combination representing a valid poker hand as a poker hand condition.

4. The device according to claim 3 wherein:

the memory stores a plurality of point values each associated with a corresponding combination of symbols as a poker hand condition; and the determining means responds to at least one poker hand condition for generating a score for the user from a sum of at least one point value associated with the at least one poker hand condition.

5. The device according to claim 1 wherein the matrix symbol generator, the selectable symbol generator, the selection means, and the determining means are implemented in software and operated on a computer system.

6. A system for playing a poker-style game with a plurality of users comprising:

a plurality of input devices, each associated with a respective user, for receiving inputs from each respective user;

a plurality of displays associated with a respective user for displaying a respective display matrix of columns and rows of matrix display regions to the respective user;

a processor executing an application program for implementing:

a selectable symbol generator, responsive to the user inputs corresponding to actuation of each respective actuation icon by each respective user, for randomly generating a plurality of sets of selectable symbols, each of the plurality of sets corresponding to a respective user and displayed to the respective user by a respective display of the respective user, the selectable symbols corresponding to poker playing cards, the size of the selectable symbol set equal and corresponding to the number of columns within the display matrix;

selection means for causing a selected symbol displayed by the symbol generator in at least one of the selection display regions of a respective user to be displayed to a respective user in a selected matrix display region of the display matrix; and determining means for determining whether the display matrix of a respective user displays a combination of symbols corresponding to a poker hand condition, and for generating a poker hand indication signal for indicating the poker hand condition with an associated point value associated with the respective user; and a plurality of graphic user interfaces (GUIs), each respective GUI generated by the processor and interacting with a respective input device and a respective display, for respectively displaying the display matrix, the sets of selectable symbols generated by the selectable symbol generator, and a plurality of activation icons to each respective user, the GUI responsive to a respective user activating the selectable symbol generator for generating a respective set of selectable symbols for a corresponding one of the plurality of users, wherein the plurality of activation icons respond to corresponding user inputs from the plurality of users, respectively.

7. The system accordingly to claim 6 wherein:

the processor includes a first computer; and the plurality of input devices include a plurality of computing devices remotely disposed relative to the processor.

8. The system according to claim 7 wherein the processor is connected to the plurality of input devices through the Internet; and the plurality of input devices includes a plurality of computing devices having means for Internet-compatible operation.

9. The system according to claim 8 wherein the processor includes software, responsive to text inputs from the plurality of input devices, for generating a common chat room display of the text inputs; and the plurality of input devices displays the common chat room display for displaying the text inputs.

10. A method for playing a poker-style game with a plurality of users using respective input devices and respective displays, comprising the steps of:

displaying a respective display matrix of columns and rows of matrix display regions to each respective user;

receiving a respective actuation signal from each respective user;

randomly generating and displaying a plurality of sets of selectable symbols;

receiving user inputs from the plurality of users to select a respective displayed selectable symbol;

causing each selected symbol to be displayed to a respective user in a selected matrix display region of the display matrix;

determining whether the display matrix of a respective user displays a combination of symbols corresponding to at least one poker hand condition;

generating a poker hand indication signal for indicating the poker hand condition with an associated point value associated with the respective user;

generating a score for each respective user from the point values associated with the at least one poker hand condition; and displaying the scores of the plurality of users to each of the plurality of users.

11. The method of claim 10 wherein the step of randomly generating a plurality of sets of selectable symbols includes the step of:

randomly generating the plurality of sets of selectable symbols, wherein each of the plurality of sets corresponding to a respective user and displayed to the respective user by a respective display of the respective user, the selectable symbols corresponding to poker playing cards, the size of the selectable symbol set equal and corresponding to the number of columns within the display matrix.

* * * * *